US005097175A

United States Patent [19]

Thomas

[11] Patent Number: 5,097,175

[45] Date of Patent: Mar. 17, 1992

[54] THIN FILM PHOSPHOR SCREEN STRUCTURE

[75] Inventor: Nils I. Thomas, Roanoke, Va.

[73] Assignee: ITT Corporation, New York, N.Y.

[21] Appl. No.: 532,813

[22] Filed: Jun. 4, 1990

[51] Int. Cl.[5] ..... H01J 29/10

[52] U.S. Cl. ..... 313/461; 313/466; 313/474; 427/64; 427/68

[58] Field of Search ..... 313/461, 466, 474, 503, 313/502, 468, 498; 427/64, 68

[56] References Cited

U.S. PATENT DOCUMENTS 3,821,009 6/1974 Lerner et al. ..... 427/64
4,713,557 12/1987 Gualtieri et al. ..... 313/474

*Primary Examiner*—Donald J. Yusko
*Assistant Examiner*—Diab Hamadi
*Attorney, Agent, or Firm*—Arthur L. Plevy; Patrick M. Hogan

[57] ABSTRACT

A thin film phosphor screen structure includes a light-transmitting substrate layer, a phosphor layer on the substrate layer formed with a plurality of parabolic-shaped cells containing phosphor material, and a reflective layer coated over the parabolic phosphor cells for reflecting light generated in the cells for transmission externally through the substrate layer. The parabolic cells are configured corresponding to the desired resolution of the display and to critical angle of diffraction for the phosphor/substrate interface. An anti-reflection coating may be applied at the phosphor/substrate interface. The phosphor layer may have a graded dopant structure or an impressed electric field for causing generated electrons to migrate toward the focal plane of the parabolic phosphor cells.

12 Claims, 2 Drawing Sheets

THIN FILM PHOSPHOR SCREEN STRUCTURE

FIELD OF INVENTION

The present invention relates to a thin film phosphor screen, and particularly, to such a phosphor screen having an improved surface structure for enhanced screen output efficiency.

BACKGROUND OF THE INVENTION

Luminescent phosphor screens are used in cathode ray tubes, for example, television display tubes, electron display devices, imaging devices, for example, image intensifier tubes, etc. Typically, a thin layer of phosphor material containing a luminescence activator is supported on a substrate. The phosphor layer is activated by impingement of an electron beam, and the resulting luminescence is transmitted through the glass substrate at the front of the display. The phosphor layer may be formed as a monocrystalline layer grown on a substrate by liquid phase epitaxy (LPE), or as a thin film deposited by evaporation, sputtering, or vapor deposition (MOCVD/MOVPE) techniques. Such phosphor layers have a relatively high thermal loadability and luminescence.

However, due to a difference in index of refraction, most of the light that is generated by the electron beam in the phosphor layer is internally trapped by reflection from the substrate layer, resulting in a relatively low external screen efficiency. Other types of phosphor layers, such as powdered phosphors, may be used to avoid the reflection losses, but these have comparatively low thermal loadability, low resolving power, and/or high outgassing losses in the vacuum manufacture of a cathode ray tube. By comparison, a thin film phosphor screen has a high resolution and a low outgassing characteristic which enhances life and performance and makes it particularly suitable for devices such as image intensifier tubes.

The problem of internal reflection of monocrystalline or thin film phosphors is illustrated schematically in FIG. 1. An electron beam $e^-$ impinges on the phosphor layer through a metal layer, e.g. aluminum, which is optional in some applications. The electron beam activates an activator element, for example, copper in zinc-sulfide based phosphors, or cerium in yttrium-aluminum-garnet phosphors, which causes electrons to be released and photons from the nearby phosphor material to be emitted with a luminescence effect. Due to the difference in index of refraction between the phosphor layer and the substrate layer, such as glass, light rays which are incident at an angle greater than the critical angle CA are reflected internally and become trapped and dissipated within the film. Another form of light loss is attributable to reflections from the substrate layer even within the cone (indicated by the dashed lines) of the critical angle CA, which increases as the light rays approach the critical angle.

As an example, the internal reflection loss due to the refraction difference for ZnS based phosphors grown on Corning type 7056 glass substrate can be as high as 75% to 80% of the light emitted. Within the acceptance angle, the reflection loss can be another 10%, for a total loss of about 90% of the radiated energy. Such high losses result in lower phosphor efficiencies than other types of phosphor layers, e.g. powdered phosphors. The result is that thin film phosphors have had limited application heretofore.

Some researchers have proposed forming reticulated structures in the phosphor layer to break up the waveguide effect and enhance light output. For example, U.S. Pat. 4,298,820 to Bongers et al. discloses the technique of etching V-shaped grooves in square patterns in the surface of the phosphor layer to obtain improved phosphor efficiency by a factor of 1.5. However, the etching process used in Bongers has been found to be impractical for large volume production.

Etching the activated portion of the phosphor layer with reticulations in the form of trapezoid- or truncated-cone-shaped mesas and overcoating with a reflective aluminum film to form light confining surfaces has been proposed in the article entitled "Reticulated Single-Crystal Luminescent Screen", by D. T. C. Huo and T. W. Huo, Journal of Electrochemical Society, Vol. 133, No. 7, pp. 1492-97, July 1986, and in "RF Sputtered Luminescent Rare Earth Oxysulfide Films", by Maple and Buchanan, Journal of Vacuum Technology, Vol 10, No. 5, pg. 619, Sept./Oct. 1973. These trapezoidal mesas improve the light output by a factor of about 2, whereas a factor of 6 or higher would represent output of most of the emitted light. The light output factor could be increased if the mesa size could be made less than 5 microns and the shape made with the optimum reflection angle. However, such a small mesa size requires high lithography resolution and is limited by diffraction from the lithography mask. Crystalline phosphors will also preferentially etch along crystalline planes which are different from the optimum slope angle for the trapezoid shape. Thus, application of trapezoidal mesas has also been limited.

SUMMARY OF THE INVENTION

It is therefore a principal object of the invention to provide a thin film phosphor screen which has a high external screen output efficiency and which is relatively simple and inexpensive to manufacture. It is a particular object to improve screen efficiency by a factor of 5 or greater, so that 90% or more of the emitted light is transmitted from the phosphor layer externally.

In accordance with the invention, a thin film phosphor screen structure comprises a light-transmitting substrate layer, a phosphor layer on the substrate layer formed with a plurality of cells each having an approximately parabolic shape facing the substrate layer and containing phosphor material having activator elements distributed therein, and a reflective overcoating layer on the parabolic phosphor cells for reflecting internally reflected light for transmission externally through said substrate layer. The edges of the parabolic cells may extend to the substrate layer, or to a non-activated thin film layer interposed therebetween. The parabolic shape is selected to have a width which corresponds approximately to a desired resolution for the resulting display, and a focal area which corresponds to the critical angle of diffraction for the phosphor/substrate interface. An anti-reflection coating may also be applied at the interface with the substrate layer to reduce reflection back into the phosphor layer. The invention also comprises the corresponding method of producing such a thin film phosphor screen structure.

In accordance with another aspect of the invention, the phosphor layer has a graded dopant structure which creates an electric field effect that causes electrons to migrate toward the spatial position of the focal plane of the parabolic phosphor cells. The graded dopant structure may also be used with conventional trapezoidal mesas and other reticulated thin film phosphor structures to enhance light output.

In accordance with a further aspect of the invention, an external electric field may be impressed across the phosphor layer to cause activator electrons to drift toward the focal plane of the parabolic cells. Similarly, an impressed electric field may also be used with other reticulated thin film phosphor structures to enhance light output.

BRIEF DESCRIPTION OF THE DRAWINGS

The above objects and further features and advantages of the invention are described in detail below in conjunction with the drawings, of which.

DETAILED DESCRIPTION OF THE INVENTION

Figure 1:
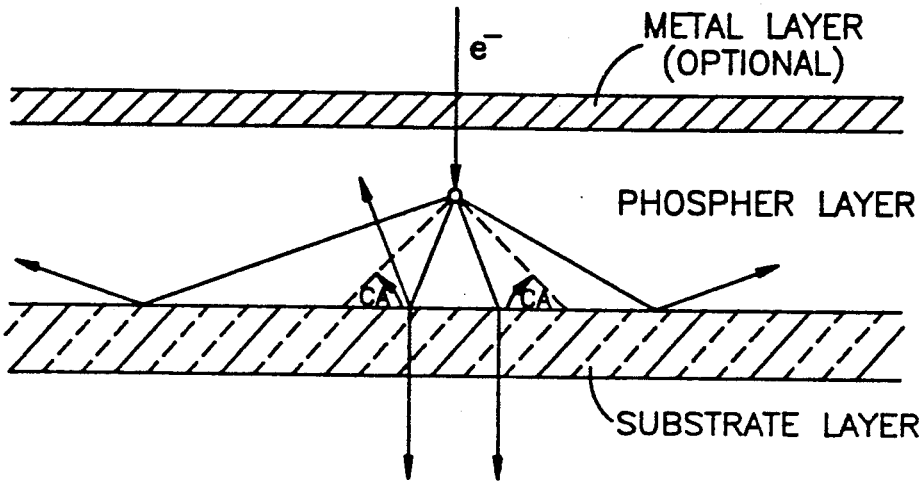
FIG. 1 is a schematic diagram of a conventional thin film phosphor screen.
Figure 2:
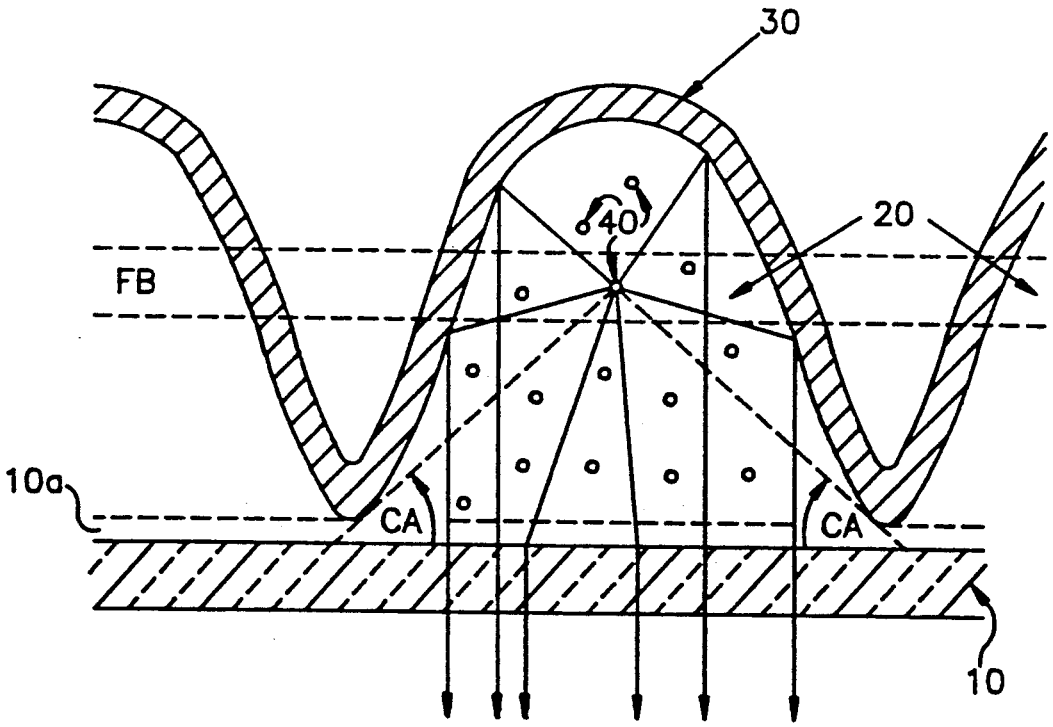
FIG. 2 is a schematic diagram of a phosphor film structure having parabolic cells in accordance with the invention.

Referring to FIG. 2, one embodiment of the invention is shown having a substrate layer 10 made of a glass or other light-transmissive material, a phosphor layer 20 in the form of a plurality of cells of approximately parabolic shape containing phosphor material facing the substrate layer 10, and a reflective overcoating layer 30 of reflective metal or other reflective material over the parabolic phosphor cells. In the preferred embodiment, the phosphor material is ZnS and contains activator elements, e.g. elemental copper, distributed therein. When impinged by an electron beam, the activator elements emit electrons which cause nearby phosphor material to emit light. The light emission centers around the activator elements are designated by reference numeral 40 in the drawings.

The light ray paths for an emission center at or near the focal point of the parabolic shape of the cell are traced in FIG. 2. The light rays within the critical angle CA to the substrate interface pass through the substrate as normal. In the ideal case, the parabolic cells are formed so that their edges extend down to the substrate layer 10, and the angle from the focal point of the parabola to the edges is within the critical angle for non-reflection due to refraction index differences at the film/substrate interface. Alternatively, the activated phosphor layer may be superimposed on a non-activated layer of the same material, and the edges of the parabolic cells may extend to the non-activated layer. The light output from the emission centers of the activated layer will pass through the non-activated layer without a difference in diffraction index.

The light rays outside the critical angle are reflected from the reflective surface of the overcoating layer 30 through the substrate layer. For emission centers at or within a close range of the focal plane of the parabolic phosphor cells, indicated by the dashed-line band FB, almost all of the light rays are transmitted through the substrate layer 10 either directly from the emission center or after one reflection from the overcoating layer. In the optimal case, the widths of the parabolic cells at the edges adjacent to the substrate layer correspond to the resolution desired for the screen.

Some light rays will be subject to more than one internal reflection, for example, those from emission centers remote from the focal area or those reflected from the film/substrate interface near the critical angle, but due to the confined shape of the cells, most are eventually transmitted through the substrate layer. To decrease reflection losses even further, an anti-reflection coating can be applied to the film/substrate interface, as indicated in phantom line and reference numeral 10a. Such anti-reflection coatings in materials are well known in the art. The absorption and Fresnel reflection losses thus become only a small part of the total light emitted. As a result, 90% or more of the light emitted from the emission centers is transmitted as light output, and the external screen efficiency of the described phosphor screen structure is improved by a factor of 5 or more compared to conventional phosphor thin films.

Figure 3A:
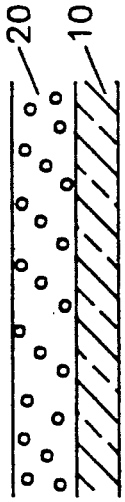
FIG. 3A, 3B, and 3C show the steps in the process of making the phosphor screen structure of FIG. 2.
Figure 3B:
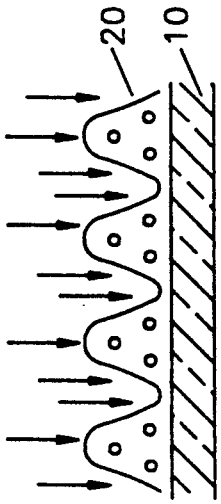
Figure 3C:
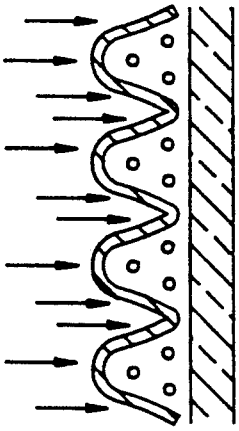

FIGS. 3A–C illustrate the steps for producing the phosphor screen with parabolic cells. In FIG. 3A, a phosphor screen is formed by growing or depositing a thin film 20 of activated phosphor material on a substrate 10. In FIG. 3B, the exposed surface of the phosphor film is etched by an appropriate lithography technique with a mask to produce approximately parabolic shapes. It is not necessary that an exact parabola shape be formed. Many other shapes can approximate a parabola, for example, a cosine wave is a first approximation of a parabola (as defined by its Taylor series expansion). In fact, any function that can be expanded to have a second order term in the Taylor series can approximate a parabola, e.g., spheres, hyperbolas, Bessel functions, sine functions, etc. Diffraction is a problem in lithography where angular surfaces are to be formed. However, the diffraction function approximates the parabola function, so that the lithography mask can be designed in the present invention to take advantage of the diffraction function to form the appropriate pattern on the phosphor surface. In FIG. 3C, a reflective coating, such as an aluminum film, is formed or deposited on the patterned surface of the parabolic cells.

As mentioned above, not all of the light generated in the parabolic cells is transmitted as light output due to absorption after multiple reflections off the reflective layer. For example, an aluminum layer typically has a reflectance of 85%. Light output can be maximized if the light rays required only one reflection off the reflective layer to exit the cell. This can be obtained if most or substantially all of the emission centers is distributed in the focal band FB encompassing the focal plane of the parabolic cells. In accordance with another aspect of the invention, the phosphor layer has a graded structure so that the phosphor activator elements are distributed in the FB band.

Figure 4B:
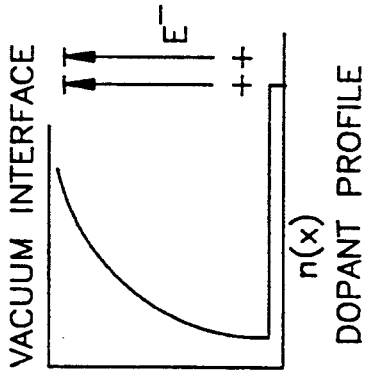
FIG. 4B is the dopant profile.
Figure 4A:
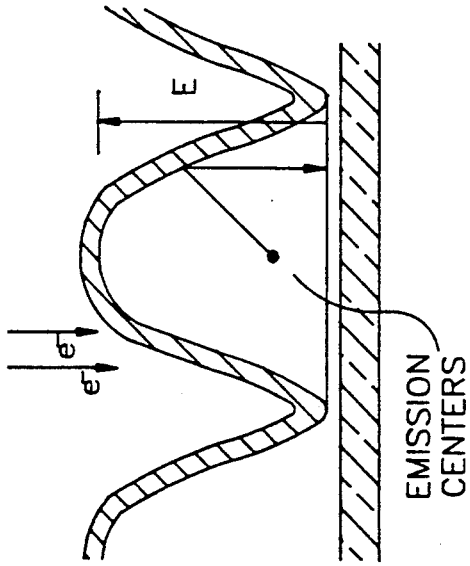
FIG. 4A is a schematic diagram of another embodiment of the phosphor screen structure.

As illustrated in FIG. 4A, this enhancement can be accomplished by grading the dopant level with ternary or quatenary compounds in the phosphor layer from the glass surface to the beam-exposed surface. The semiconductor heterojunctions between dopant levels create an electric field effect across the cell. Electrons generated by the electron beam will then tend to drift or migrate in the electric field toward the focal plane FB, where they cause photon emission which will be collimated as light output after one reflection from the parabolic reflective surface. Thus, the optical loss can be reduced to only the reflection loss from the film/substrate interface, and the latter can be reduced even further by the anti-reflection coating 10a in FIG. 2. As an example, the optical loss for a graded ZnS parabolic phosphor layer can be reduced to 6%, even without an anti-reflection coating. The dopant grading enhancement may also be used with the previously proposed trapezoid mesas and other reticulated phosphor screen structures, since its effect is to cause electrons to migrate towards a selected spatial position where the emitted light will be primarily reflected or directed toward the substrate as light output. Thus, this feature can e used even where the phosphor film is not or cannot be etched in a parabolic shape.

As can be seen from FIG. 4B, the gradient is a continuous change in dopant level versus spatial position. The gradient being continuous is a function of $e^{-nx}$. This is a representative function only. Any dopant function which causes the electrons to drift to the focal plane is acceptable. Thus as seen in FIG. 4A is the dopant profile which essentially is produced within the region between the metal and the substrate. A typical emission center is shown on the diagram and most methods of doping ternary or quatenary compounds result in a continuous change in doping level. As indicated, this continuous change is adequately provided and is not implemented as a stepwise change. Stepwise heterojunctions will work but are not ideal. The compounds as employed are ternary or quaternary compounds which contain three or four elements. As seen in the figure, the metal layer may be composed of aluminum or some other suitable metal reflecting material while the doping profile in conjunction with the aspects of FIG. 4B show a graded junction parabolic approach.

Figure 5:
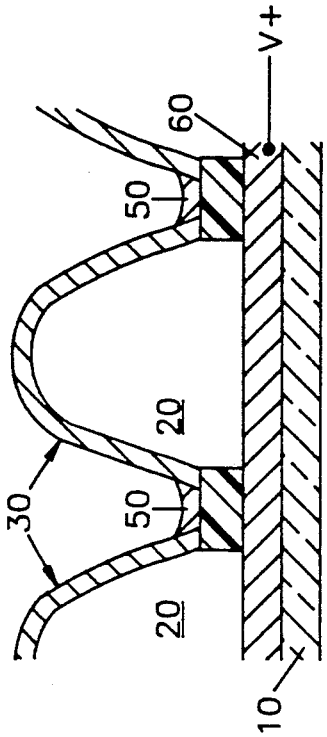
FIG. 5 is a schematic diagram of a further embodiment of the phosphor screen structure.

It is not possible to create a graded dopant profile in some phosphors, notably those consisting of refractory materials. Another way to cause electron migration is to impress an electric field by applying external voltages to the phosphor screen. For example, as shown in FIG. 5, a positive voltage V+is impressed on a conductive, transparent layer 60 interposed between the substrate layer 10 and the phosphor layer 20. A negative voltage V− is impressed on the reflective metal layer 30. Insulation layers 50 are formed between the conductive layer 60 and the metal layer 30. The applied potentials are selected so that electrons generated by electron beam impingement migrate toward the focal band FB of the parabolic cells. The applied potentials are relatively low, for example, on the order of a few volts per meter.

In summary, the phosphor screen structures and techniques of the invention enhance the light output substantially over conventional thin film phosphor screens. The parabolic phosphor cells are designed to allow substantially all of the light emitted to be transmitted as light output. Unlike the trapezoidal mesas, the parabolic cells are not sensitive to manufacture at a required optimal angle or to manufacturing tolerances. Any second order function approximating a parabola can achieve a significant enhancement effect. Moreover, the lithography mask diffraction function is used to advantage in forming the parabolic shape. Thus, parabolic cells of less than 1 micron can be fabricated, which is particularly needed for image intensifier screens which need a resolution of 3 microns or less. The further enhancements of the graded dopant levels or low-order impressed electrical field further reduce optical losses by causing light emission in the focal region where most of the light will be transmitted without multiple reflections. These features are also useful for phosphor films which cannot be etched in a parabolic shape.

The specific embodiments of the invention described herein are intended to be illustrative only, and many other variations and modifications may be made thereto in accordance with the principles of the invention. All such embodiments and variations and modifications thereof are considered to be within the scope of the invention, as defined in the following claims.

I claim:

1. A thin film phosphor screen structure comprising:

a light-transmitting substrate layer;

a phosphor layer on the substrate layer formed with a plurality of cells each having an approximately parabolic shape facing the substrate layer and containing phosphor material having activator elements distributed therein, said cells selected to have a focal area position which lies within a critical angle of reflection between said phosphor layer and said substrate layer; and a reflective layer coated over the parabolic phosphor cells for reflecting light generated in the phosphor cells for transmission externally through said substrate layer.

2. A thin film phosphor screen structure according to claim 1, wherein said reflective layer is an aluminum film deposited on the parabolic phosphor cells.

3. A thin film phosphor screen structure according to claim 1, further comprising an anti-reflection coating applied to the substrate layer at an interface thereof with the phosphor layer.

4. A thin film phosphor screen structure according to claim 1, wherein said phosphor layer is formed of a semi-conductor material having a graded dopant structure for causing electrons generated from the activator elements to migrate toward the spatial position of a focal plane of the parabolic phosphor cells.

5. A thin film phosphor screen structure according to claim 1, wherein said parabolic cells have edged that extend to the substrate layer.

6. A thin film phosphor screen structure according to claim 5, wherein said parabolic cells are selected to have a width across their edges corresponding approximately to a desired resolution of light output for the phosphor screen structure.

7. A thin film phosphor screen structure according to claim, further comprising a transparent, conductive layer interposed between the substrate layer and the parabolic phosphor cells to which a positive voltage is applied, said reflective layer being a conductive metal layer to which a negative voltage is applied, and an insulator layer interposed between said transparent, conductive layer and said metal layer, wherein said applied voltages create an impressed electric field causing electrons generated from the activator elements to migrate toward a focal plane of the parabolic cells.

8. A thin film phosphor screen structure according to claim 7, wherein said parabolic phosphor cells and graded dopant levels are configured such that 94% or more of the light emitted by the activator elements are transmitted through the substrate layer as light output.

9. A thin film phosphor screen structure according to claim 1, wherein said parabolic phosphor cells are configured such that 90% or more of the light emitted by the activator elements are transmitted through the substrate layer as light output.

10. A thin film phosphor screen structure according to claim 9, wherein said parabolic phosphor cells are configured and said applied voltages are selected such that 94% or more of the light emitted by the activator elements are transmitted through the substrate layer as light output.

11. A thin film phosphor screen structure comprising:

a light-transmitting substrate layer;

a phosphor layer on the substrate layer formed with a plurality of reticulated cells each having a light-ray-confining shape facing the substrate layer and containing phosphor material having activator elements distributed therein; and a reflective layer coated over the parabolic phosphor cells for reflecting light generated in said cells for transmission externally through said substrate layer, wherein said phosphor layer is formed of a semiconductor material having a graded dopant structure for causing electrons generated from the activator elements to migrate toward a predetermined spatial position within the light-ray-confining shape of said cells, said predetermined spatial position coinciding with a focal plane for said reticulated cells.

12. A thin film phosphor screen structure comprising:

a light-transmitting substrate layer;

a phosphor layer on the substrate layer formed with a plurality of reticulated cells each having a light-ray-confining shape facing the substrate layer and containing phosphor material having activator elements distributed therein;

a reflective layer coated over the phosphor cells for reflecting light generated in said cells for transmission externally through said substrate layer, said reflective layer being a conductive metal layer to which a negative voltage is applied;

a transparent, conductive layer interposed between the substrate layer and the phosphor cells to which a positive voltage is applied; and an insulator layer interposed between said transparent, conductive layer and said metal layer, wherein application of the voltages to said transparent, conductive layer and to said conductive, reflective layer impresses an electric field causing electrons generated from the activator elements to migrate to a predetermined spatial position within the light-ray-confining shape of said cells.

* * * * *

UNITED STATES PATENT AND TRADEMARK OFFICE

CERTIFICATE OF CORRECTION

PATENT NO. : 5,097,175

DATED : March 17, 1992

INVENTOR(S) : Nils I. Thomas

It is certified that error appears in the above-indentified patent and that said Letters Patent is hereby corrected as shown below:

Claim 7, column 6, line 49, after "claim" insert --1--.

Signed and Sealed this

Twentieth Day of July, 1993

*Attest:*

*Attesting Officer*

Michael K. Kirk

MICHAEL K. KIRK

*Acting Commissioner of Patents and Trademarks*